US005123249A

United States Patent [19]

Buttle

[11] Patent Number: 5,123,249

[45] Date of Patent: Jun. 23, 1992

[54] AIR SEPARATION

[75] Inventor: Andrea Buttle, Surrey, England

[73] Assignee: The BOC Group plc, Windlesham, England

[21] Appl. No.: 686,738

[22] Filed: Apr. 17, 1991

[30] Foreign Application Priority Data

Apr. 18, 1990 [GB] United Kingdom ..... 9008752

[51] Int. Cl.[5] ..... F25J 3/02

[52] U.S. Cl. ..... 62/24; 62/38; 62/43

[58] Field of Search ..... 62/13, 24, 38, 43

[56] References Cited

U.S. PATENT DOCUMENTS

| | | | |
|---|---|---|---|
| 3,086,371 | 4/1963 | Schilling et al. | 62/43 |
| 4,224,045 | 9/1980 | Olsewski et al. | 62/38 |
| 4,303,428 | 12/1981 | Vandenbussche | 62/13 |
| 4,410,343 | 10/1983 | Ziemer | 62/43 |
| 4,696,689 | 9/1987 | Mori et al. | 62/38 |
| 4,883,518 | 11/1989 | Skolaude et al. | 62/38 |

FOREIGN PATENT DOCUMENTS

| | | |
|---|---|---|
| 1520103 | 3/1977 | European Pat. Off. . |
| 0260002 | 3/1988 | European Pat. Off. . |
| 0321163 | 6/1989 | European Pat. Off. . |
| 0341854 | 11/1989 | European Pat. Off. . |
| 2854508 | 6/1980 | Fed. Rep. of Germany . |

*Primary Examiner*—Ronald C. Capossela
*Attorney, Agent, or Firm*—Robert I. Pearlman; David M. Rosenblum

[57] ABSTRACT

A compressed air stream is separated in a double rectification column having a higher pressure stage and a lower pressure stage. The lower pressure stage contains a low pressure drop liquid-vapor contact means having a pressure drop of less than about 400.0 Pa per theoretical stage, for example a structured packing, to effect mass transfer between ascending vapor and descending liquid. A product gaseous oxygen stream is withdrawn from the lower pressure stage through an outlet thereof and is warmed to about ambient temperature in a heat exchanger in countercurrent flow relationship with the compressed air stream which is thereby cooled. Refrigeration for the process is created by expansion of part of the incoming air. By using a low pressure drop liquid-vapor contact means in the lower pressure stage, the resulting operating pressure in the higher pressure stage is able to be lower than in a conventional process enabling the incoming air to be compressed to a lower pressure (for example a pressure in a range of about 5.0 to 6.0 bar). At such pressures, two expansion turbines are used to enable the heat exchanger to be operated efficiently.

10 Claims, 5 Drawing Sheets

DELTA T (K)
6.0
5.8
5.6
5.4
5.2
5.0
4.8
4.6
4.4
4.2
4.0
3.8
3.6
3.4
3.2
3.0
2.8
2.6
2.4
2.2
2.0
1.8
1.6
1.4
1.2
1.0
0.8
0.6
0.4
0.2
0.0
B (5.6bar)
A (6.5bar)
0
5
10
15
20
25
30
35
40
45
50
55
60
ENTHALPY CHANGE FROM COLD TO WARM END (KCAL/SM3)

B
1 Turbine)
C (2 Turbines)
DELTA
T
(K)
ENTHALPY CHANGE FROM COLD TO WARM END (KCAL/SM3)
0.0
0.2
0.4
0.6
0.8
1.0
1.2
1.4
1.6
1.8
2.0
2.2
2.4
2.6
2.8
3.0
3.2
3.4
3.6
3.8
4.0
4.2
4.4
4.6
4.8
5.0
5.2
5.4
5.6
5.8
6.0
0
5
10
15
20
25
30
35
40
45
50
55
60

AIR SEPARATION

BACKGROUND OF THE INVENTION

This invention relates to the separation of air, particularly to produce an oxygen product.

The separation of air by rectification at cryogenic temperatures to produce a gaseous oxygen product is a well known commercial process. As commonly practised, the process includes purifying compressed air to remove constituents such as carbon dioxide and water vapour of relatively low volatility in comparison with that of oxygen or nitrogen. The air is then cooled in a heat exchanger to about its saturation temperature at the prevailing pressure. The resulting cooled air is introduced into the higher pressure stage of a double rectification column comprising higher pressure and lower pressure stages. Both stages contain liquid-contact vapour means which enable there to take place intimate contact and hence mass exchange between a descending liquid phase and an ascending vapour phase. The lower and higher pressure stages of the double rectification column are linked by a condenser-reboiler in which nitrogen vapour at the top of the higher pressure stage is condensed by boiling liquid oxygen at the bottom of the lower pressure stage. The higher pressure stage provides an oxygen-enriched liquid feed for the lower pressure stage and liquid nitrogen reflux for that stage. The lower pressure stage produces an oxygen product and typically a nitrogen product. Usually, nitrogen product is taken from the top of the low pressure stage, and a waste nitrogen stream is withdrawn from a level a little bit below that at which the nitrogen gas is at its maximum purity level. The oxygen and nitrogen product streams and the waste nitrogen stream are returned through the heat exchanger countercurrently to the incoming compressed air stream and are thus warmed as the compressed air stream is cooled.

If desired, the process may also be used to produce an impure argon product. If such a product is desired, a stream of oxygen vapour enriched in argon is withdrawn from an intermediate level of the lower pressure stage and is fractionated in a third rectification column containing liquid-vapour contact means. This column is provided with a condenser at its top and some of the oxygen-enriched liquid withdrawn from the higher pressure stage may be used to provide cooling for this condenser. An argon product may be withdrawn from the top of the argon separation column and liquid oxygen may be returned from the bottom of the argon column to the lower pressure stage of the double rectification column.

Since the rectification of the air takes place at cryogenic temperatures, it is necessary to provide refrigeration for the process. This is conventionally done by taking a portion of the condensed air stream at a suitably low temperature and expanding it with the performance of external work in a turbine and then introducing it into either the higher pressure or lower pressure stage of the double rectification column. Sometimes, particularly if a proportion of the oxygen production is to be in the liquid phase, the compressed air stream is split and a minor portion of it is further compressed, cooled in the heat exchanger and then expanded in the turbine and introduced into the lower pressure stage of the rectification column. See, for example, U.S. Pat. No. 4,746,343 and DE-B-2854508. An alternative well known method of providing refrigeration is to take a nitrogen vapour stream from the higher pressure stage of the double rectification column to return the stream for part of the way through the heat exchanger and then to expand it with the performance of external work in a turbine which returns the nitrogen to a lower pressure nitrogen stream entering the cold end of the heat exchanger. Such cycles are described as prior art in EP-A-321 163 and EP-A-341 854.

Generally, therefore, in the production of oxygen gas product by cryogenic rectification of air, a single turbine is used to provide the refrigeration for the process. It has however been proposed to use more than one turbine to produce the necessary refrigeration when producing an oxygen product. First, if the oxygen product is required entirely in the liquid state, it has been proposed to use two separate turbines. The use of two such turbines in these circumstances is hardly surprising as the requirement to produce all the oxygen in the liquid state adds considerably to the overall requirement of the process for refrigeration. In GB-A-1 520 103 a first expander 17 produces a stream of cold air at −136° F. (180° K.) and a second expander 22 takes air at a temperature of −159° F. (161° K.) and by expansion reduces its temperature to −271° F. (105° K.), which air is then introduced into the higher pressure stage of the rectification column. A similar process is disclosed in U.S. Pat. No. 4,883,518. It has also been proposed to improve an air separation cycle in which the main refrigeration is provided by a first air turbine which does not supply air directly to the lower pressure stage of the rectification column by adding a second turbine that does just that. See for example EP-A-260 002. Such an expedient, however, requires both turbines to have an exit temperature of less than 110° K.

In designing an air separation process, the conditions in the lower pressure stage of the double column are particularly important. Typically, it is desired to produce the product gases from the lower pressure stage at atmospheric pressure. In order to ensure that there is an adequate pressure for the products to flow through the heat exchange system it is desirable for the pressure at the top of the lower pressure stage of the double column to be fractionally above atmospheric pressure. The pressure at the bottom of the lower stage of the column will then depend on the number of theoretical stages of separation selected for the lower pressure column and the pressure drop per theoretical stage. Since it is typically necessary for the gaseous nitrogen at the top of the higher pressure stage to be about 2° K. higher in temperature than the liquid oxygen at the bottom of the lower pressure stage for the condenser-reboiler to operate properly, the pressure at the bottom of the lower stage effectively determines the pressure at the top of the higher pressure stage of the double column. The pressure at the bottom of the higher pressure stage of the double column will thus depend on the value at the top of the stage, the number of theoretical stages of separation in the higher pressure stage of the double column, and the pressure drop per theoretical stage. The pressure at the bottom of the higher pressure column in turn dictates the pressure to which the incoming air needs to be compressed. Generally, at least in the lower pressure stage of the double column, the average pressure drop per theoretical liquid-vapour contact tray is normally above 500 Pa (0.075 psi). It is well known in the art that column packings may be used instead of distillation trays in order to effect liquid-vapour contact. One feature of such packings is that they tend to have lower pressure drops per theoretical stage of the separation than trays, although there is a tendency in modern tray design for air separation columns to reduce the pressure drop per theoretical tray below levels that have been traditionally used. Since the lower pressure stage may contain a large number of theoretical stages of separation (typically over 50 stages) designing the lower pressure stage with a low pressure liquid-vapour contact means, be it a packing or a multiplicity of trays, does have an appreciable influence on the operating parameters of the air separation cycle, and particularly makes possible a reduction in the pressure to which the incoming air needs to be compressed. Even though the total reduction in the pressure to which the incoming air may be compressed is typically in the order of 0.5 to 1 bar, we have surprisingly found that this pressure drop has a profound effect on the thermodynamic efficiency of the heat exchange system within the process and makes desirable substantial changes to the refrigeration system employed. Notwithstanding the fact that EP-A-321 163 and EP-A-341 854 both disclose the use of low pressure drop liquid-vapour contact means in the lower pressure stage of the distillation column, the refrigeration cycle that they employ in association with the double column is of a substantially conventional nature with just one turbine being used to expand a returning nitrogen stream from the higher pressure column to the pressure of the lower pressure column.

SUMMARY OF THE INVENTION

According to the present invention, there is provided a method of separating an oxygen product from air, including reducing the temperature of a compressed air stream by heat exchange in heat exchange means to a value suitable for its separation by rectification, introducing the thus cooled air stream into the higher pressure stage of a double rectification column for the separation of air, said double rectification column comprising a lower pressure stage and a higher pressure stage, employing the higher pressure stage of the column to provide liquid nitrogen reflux and an oxygen-enriched air feed for the lower pressure stage, and withdrawing oxygen product from the lower pressure stage, wherein at least 70% of the oxygen product is taken as gas from the double rectification column, preferably at least the lower pressure stage includes a low pressure drop liquid-vapour contact means (as hereinafter defined) for effecting intimate contact and hence mass transfer between liquid and vapour, and refrigeration for the method is created in two steps by performing at least two separate expansions of fluid with the performance of external work, a first such expansion taking fluid from the heat exchange means at a higher temperature and returning the fluid thereto at a lower temperature, both said temperatures being between the temperature of the air stream at the cold end and that at the warm end of the heat exchange means, and a second such expansion producing fluid at a lowermost temperature at or below that at which the said compressed air stream leaves the cold end of the heat exchange means.

By the term "low pressure drop liquid-vapour contact means" as used herein is meant a liquid-vapour contact means which under the prevailing conditions has a pressure drop of less than 400 Pa per theoretical stage of separation. The term "theoretical stage of separation" in the case of a liquid-vapour contact tray means a theoretical tray. The number of theoretical trays used in a liquid-vapour contact column is the multiple of the actual number of trays used and the average efficiency of each tray. In the case of a packing, for example an ordered or structured packing, a theoretical stage of separation is the height equivalent of packing that gives the same separation as a theoretical tray or plate. This parameter is sometimes known as the HETP. By using ordered or structured packings in the low pressure stage, the operating pressure of the high pressure stage (at a point half-way up the stage) may be kept below 5.5 bar. A further lowering of the operating pressure in the higher pressure stage may be achieved by minimising the temperature difference between the warm end and cold end of the condenser-reboiler that provides reboil from the lower pressure stage and reflux for the higher pressure stage.

The invention also provides apparatus for separating an oxygen product from air comprising a main air compressor; heat exchange means for reducing a compressed air stream from the main air compressor to a temperature suitable for its separation by rectification; a double rectification column having a lower pressure stage and a higher pressure stage, the higher pressure stage communicating with an outlet for the compressed air stream from the heat exchange means, at least the lower pressure stage including a low pressure drop liquid-vapour contact means (as hereinbefore defined) for effecting intimate contact and hence mass transfer between liquid and vapour, conduits leading from the lower pressure stage to the higher pressure stage for transferring respectively oxygen-rich fluid from the bottom of the lower pressure stage and liquid nitrogen from the top of the higher pressure stage to the lower pressure stage, conduits for oxygen product and nitrogen leading back from the low pressure column to the cold end of the heat exchange means whereby oxygen and nitrogen are able to pass back through the heat exchange means in countercurrent heat exchange relationship to the incoming air, a first expansion turbine for producing refrigeration for the apparatus which in use takes fluid from the heat exchange means at a higher temperature and returns the fluid thereto at a lower temperature, both said temperatures being between the temperature of the air stream at the cold end and at the warm end of the heat exchange means, and a second such expansion turbine which in use has an outlet temperature at or below that at which the compressed air stream leaves the cold end of the heat exchange means.

Preferably at least one of the (turbine) expansions is performed on compressed air taken from the compressed air stream. If desired, the compressed air stream may be the source of fluid for both expansions. In examples of the process in which the compressed air stream is the source of fluid for only one of the expansions, the fluid for the other expansion is preferably taken from a nitrogen stream withdrawn from the top of the higher pressure stage of the double rectification column.

This stream is typically expanded to the pressure of a low pressure nitrogen stream returning through the heat exchange means from the top of the lower pressure stage of the double rectification column.

Preferably air for the first expansion is compressed to a higher pressure than the said compressed air stream which is introduced into the higher pressure stage of the double column. Accordingly, the compressed air stream is split upstream of the warm end of the heat exchange means, and one part of the resulting divided air stream is further compressed in another compressor and then passed through the heat exchange means in parallel with the main air stream and then withdrawn at a suitable intermediate temperature for expansion.

Preferably, the first (turbine) expansion produces fluid at a temperature in the range of 120 to 160K. It is also preferred that the fluid for the second expansion is taken from the heat exchange means at a temperature in this range of 120° to 160° K.

When compressed air is used as the source of fluid for both (turbine) expansions, it is generally preferred that the turbines be connected in parallel with one another. It is however alternatively possible to return the expanded fluid from the first or higher temperature expansion to the heat exchange means, rewarm it in the heat exchange means to a temperature less than the temperature of the compressed air stream at the warm end of the heat exchange means, and then use the reheated air stream as the source of fluid for the second or lower temperature expansion.

When the lower temperature expansion is performed on compressed air the resulting expanded fluid may be introduced into either the higher pressure stage or the lower pressure stage of the rectification column depending on the pressure of the fluid.

The method and apparatus according to the invention are suitable for use in the operation of an air separation plant to produce the oxygen product entirely as gas or to produce up to 30% by volume (and particularly up to 10% by volume) of the oxygen product as liquid. In the latter example, the refrigeration requirements upon the process are increased with increasing proportion of oxygen product taken as liquid, particularly if the proportion of the oxygen product produced as liquid. In such examples of the process, where air is used as the source of fluid for the first and second expansions, it is typically taken for the second expansion at a pressure higher than that at which it is taken for the first expansion.

The method according to the invention is particularly useful when the pressure drops caused by the liquid-vapour contact means in the lower pressure and higher pressure stages of the double rectification column and the temperature difference between the warm end and the cold end of the condenser-reboiler are such that the higher pressure stage operates at a pressure (at the middle theoretical stage) in the range of 4.5 to 5.5 bar.

Where the source of fluid for a turbine expansion is nitrogen from the higher pressure stage, a stream of nitrogen from the top of the higher pressure stage may be passed through the heat exchange means from its cold end to its warm end and then at least part of the resulting warmed nitrogen recompressed and returned through the heat exchange means cocurrently with the main air stream, and then withdrawn therefrom at a suitable intermediate temperature and subjected to the (turbine) expansion. The resulting expanded nitrogen stream is typically then combined with a nitrogen stream being returned through the heat exchange means from the lower pressure stage of the double rectification column.

The use of two separate expansions of fluid with the performance of external work in accordance with the invention makes it possible to maintain efficient heat exchange throughout the length of the heat exchange means.

BRIEF DESCRIPTION OF THE DRAWINGS

The method and apparatus according to the invention will now be described by way of example with reference to the accompanying drawings: in which

In FIGS. 1 and 2 of the drawings, like parts are shown by the same reference numerals, and after their description with respect to FIG. 1 are not described again in FIGS. 2.

DETAILED DESCRIPTION

Figure 1:
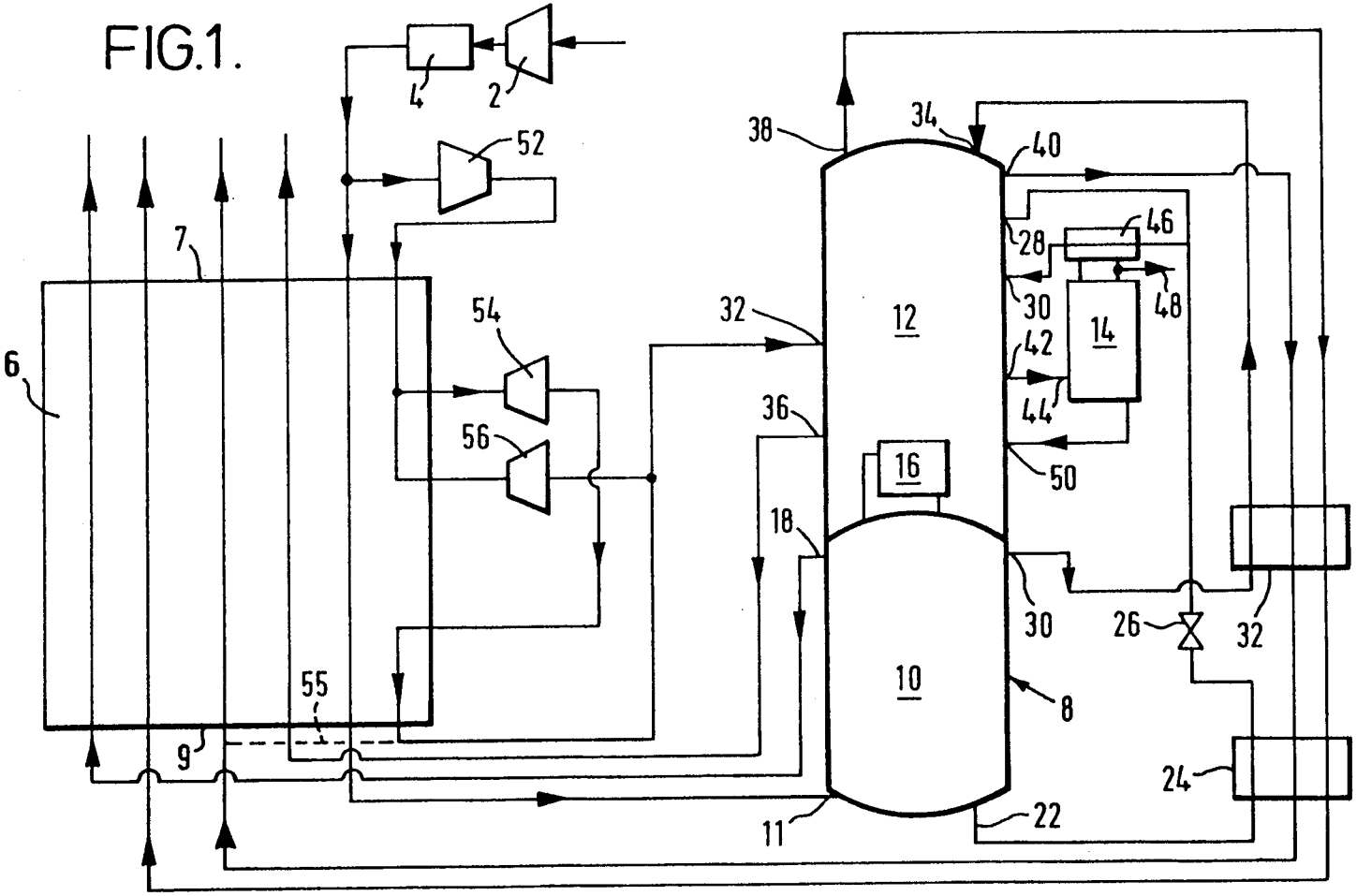
FIG. 1 is a schematic flow diagram illustrating a first method and apparatus according to the invention.

Referring to FIG. 1 of the drawings, an incoming stream of air is compressed at the compressor 2 to a pressure in the range of 5 to 6 atmospheres. The compressor 2 has an after cooler (not shown) associated with it to return with the temperature of the air after compression to a value approaching that of the ambient air. The resulting compressed air stream is then passed through a purification apparatus 4 for removing water vapour, carbon dioxide and other impurities of relatively low volatility from the air by adsorption. Typically a plurality of beds of adsorbent is employed with only some beds being used to purify the air at any one time, the other beds being regenerated by means of hot gas. The resulting purified stream air then flows it a heat exchanger means 6 at its warm end 7 (at about ambient temperature) and through the heat exchanger, leaving its cold end 9 at approximately the saturation temperature of the air.

The cooled air flows from the cold end 9 of the heat exchanger 6 into the bottom of a higher pressure stage 10 of a double rectification column 8 through an inlet 11. The rectification column 8 also includes a lower pressure stage 12 which is adapted to feed argon-enriched oxygen to an argon side rectification column 14. The columns 12 and 14 both contain low pressure drop liquid-vapour contact means 13 and 15 (for example structured packing) to effect intimate contact and hence mass exchange between a generally descending liquid phase and a generally ascending vapour phase. As has been explained hereinbefore, the operating pressure at the top of the lower pressure stage 12 of the double rectification column 8, the number of theoretical stages of separation in both the high pressure stage 10 and the low pressure stage 12 of the rectification column 8, and the average pressure drop per theoretical stage in each of the stages 10 and 12 of the rectification column 8, will determine the pressure to which the incoming air is compressed in the compressor 2, this pressure tending to be less the lower the average pressure per theoretical stage of the liquid-vapour contact means used in the stages 10 and 12 of the rectification column 8.

Apart from its use of a low-pressure drop liquid-vapour contact means, the the rectification column 8 is in other respects of a conventional kind. A condenser-reboiler 16 linking the lower pressure stage 12 and the higher pressure stage 10 of the double rectification column 8 provides liquid nitrogen reflux for the higher pressure stage 10. Thus, a descending liquid phase comes into contact with an ascending vapour phase with the result that mass exchange takes place therebetween. This vapour-liquid contact takes place on the surfaces of the liquid-vapour contact means (not shown) (for example, conventional sieve trays or a structured packing) employed in the higher pressure stage 10. Accordingly, the liquid phase as it descends the higher pressure stage 10 of the column 8 becomes progressively richer in oxygen and the vapour phase as it ascends the stage 10 becomes progressively richer in nitrogen. Substantially pure nitrogen vapour is thus provided at the top of the higher pressure stage 10. Some nitrogen vapour passes into the condenser-reboiler 16 and is condensed. The remainder leaves the column 8 through an outlet 18 and then passes back through the heat exchanger 6 from its cold end 9 to its warm end 7. The thus warmed nitrogen stream may be taken as product. If desired, however, all the nitrogen vapour may be condensed and no nitrogen product taken from the high pressure stage 10. Such a practice helps to maximise argon production.

A stream of oxygen-rich liquid is withdrawn from the bottom of the higher pressure stage 10 of the column 8 through an outlet 22 and is then sub-cooled by passage through a heat exchanger 24. The resulting sub-cooled liquid-oxygen enriched air then passes through a Joule-Thomson valve 26 and is reduced in pressure to a level suitable for its introduction into the lower pressure stage 12 of the column 8. The majority of the resulting fluid stream is introduced into the lower pressure stage 12 of the column 8 through an inlet 28. This air is then separated in the lower pressure stage 12 of the column 8 into oxygen and nitrogen products as will be described below.

A stream of liquid nitrogen condensate from the condenser-reboiler 16 is withdrawn from the higher pressure stage 10 of the rectification column 8 through an outlet 30, is sub-cooled by passage through a heat exchanger 32 and is then passed into the top of the lower pressure stage 12 of the rectification column 8 through an inlet 34. Liquid nitrogen thus descending the column and on the liquid-vapour contact means (not shown) comes into contact with ascending vapour. As it descends the column the liquid becomes progressively richer in oxygen. Substantially pure liquid oxygen collects at the bottom of the stage 12 and is reboiled by condensing nitrogen vapour in the condenser-reboiler 16, thereby creating an upward flow of vapour through the stage 12. The introduction of the oxygen-enriched air through the inlet 28 into this regime of ascending vapour and descending liquid enables the separation of the oxygen-enriched air into oxygen and nitrogen to take place. It should also be noted that a second oxygen-enriched air stream, in vapour state is introduced into the lower pressure stage 12 of the rectification column 8 through an inlet 30 as will be described below; and an expanded air stream is also introduced into the lower pressure stage 12 through an inlet 32, again as will be described below.

Three separate "product" streams are withdrawn from the lower pressure stage 12 of the rectification column 8. A stream of gaseous oxygen product is withdrawn from the bottom region of the stage 12 through an outlet 36 and passes through the heat exchanger 6 from its cold end 9 to its warm end 7. A gaseous nitrogen product stream is withdrawn from the top of the lower pressure stage 12 of the rectification column 8 through an outlet 38 and passes first through the heat exchanger 32 countercurrently to the liquid nitrogen stream withdrawn through the outlet 30 from the top of the higher pressure stage 10 of the rectification column 8; then flows through the heat exchanger 24 countercurrently to the oxygen-enriched liquid withdrawn through the outlet 22 from the higher pressure stage 10 of the rectification column 8; and then flows through the heat exchanger 6 from its cold end 9 to its warm end 7. Third, a stream of nitrogen containing a small amount of oxygen impurity is withdrawn from near the top of the lower pressure stage 12 of the rectification column 8 through an outlet 40 and returns cocurrently with the stream of nitrogen withdrawn through the outlet 38 flowing through heat exchangers 32, 24 and 6. This nitrogen stream may be used as a source of gas for regenerating the adsorbent beds of the purification apparatus 4.

The lower pressure stage 12 of the rectification column 8 is also used to supply the argon column 14 with a stream of argon-enriched oxygen for separation. Accordingly, a stream of argon-enriched oxygen is withdrawn at a suitable level from the lower pressure stage 12 of the column 8 through an outlet 42 and introduced into the column 14 through an inlet 44. Reflux for the column 14 is provided by condensing vapour passing out of the top of the column 14 in a condenser 46 by means of a part of the expanded oxygen-rich liquid stream passing through the valve 26. A part of the resulting condensate is withdrawn through outlet 48 as crude argon product while the remainder returns to the top of the column 14 as reflux. Mass exchange takes place in the column 14 between the descending liquid and ascending vapour phases. As well as a crude argon product being produced at the top of the column, a stream of liquid oxygen is returned to the lower pressure stage 12 of the column 8 through an inlet 50. The liquid oxygen-enriched air which passes through the condenser 46 is vaporised and the resulting vapour is that introduced into the stage 12 of the column 8 through the inlet 30.

In order to provide refrigeration for the method and apparatus illustrated in FIG. 1 of the drawings, a part of the incoming compressed air stream leaving the purification apparatus 4 is taken upstream of the warm end 7 of the heat exchanger 6 and is further compressed in a compressor 52 having an after cooler (not shown) associated therewith. A stream of compressed air leaves the compressor 52 at a pressure in the range 8 to 10 bar and flows into the heat exchanger 6 through its warm end 7. This stream is further divided during its passage through the heat exchange 6. A subsidiary stream is taken therefrom at a temperature typically in the order of 200° to 250° K. and is expanded with the performance of external work in a first or warm turbine 54. The resulting expanded air leaves the turbine 54 typically at the pressure of the lower pressure stage 12 and then flows back into the heat exchanger 6 at an appropriate intermediate region thereof. The stream then continues its flow through the heat exchanger 6 in a direction cocurrent with that followed by main air stream, and leaves the heat exchanger 6 through its cold end 9. This air stream is then introduced into the lower pressure stage 12 of the rectification column 8 through the inlet 32. The remainder of that air stream from which the subsidiary stream is taken for expansion in the turbine 54 is withdrawn from the heat exchanger 6 at an intermediate temperature typically in the range 120° to 160° K. and is expanded in a second or cold turbine 56 to a temperature and pressure suitable for its introduction into the lower pressure stage 12 of the rectification column 8. After leaving the turbine 56 this stream is remixed with the other exhausted air stream and thus enters the lower pressure stage 12 of the rectification column 8 through the inlet 32. If desired, however, some or all of the air from the turbines 54 and 56 may alternatively be mixed with the waste nitrogen stream upstream of the cold end 9 of the heat exchanger 6 via conduit 55.

Typically, one or both turbines 54 and 56 have their shafts coupled to the shaft of the compressor 52 and thus the work done by expansion of the air in the turbines 54 and 56 is able to be used to drive the compressor 52.

It is convenient for the gas stream exiting the warm turbine 54 to enter the heat exchanger 6 at the same temperature as that at which the feed for the cold turbine 56 is taken.

By operating the turbines 54 and 56, it is possible to maintain the temperature profile of the streams being warmed in close conformity with that of the streams being cooled in the heat exchanger 6, thereby minimising the amount of "lost work" associated with the operation of the heat exchanger 6.

Figure 2:
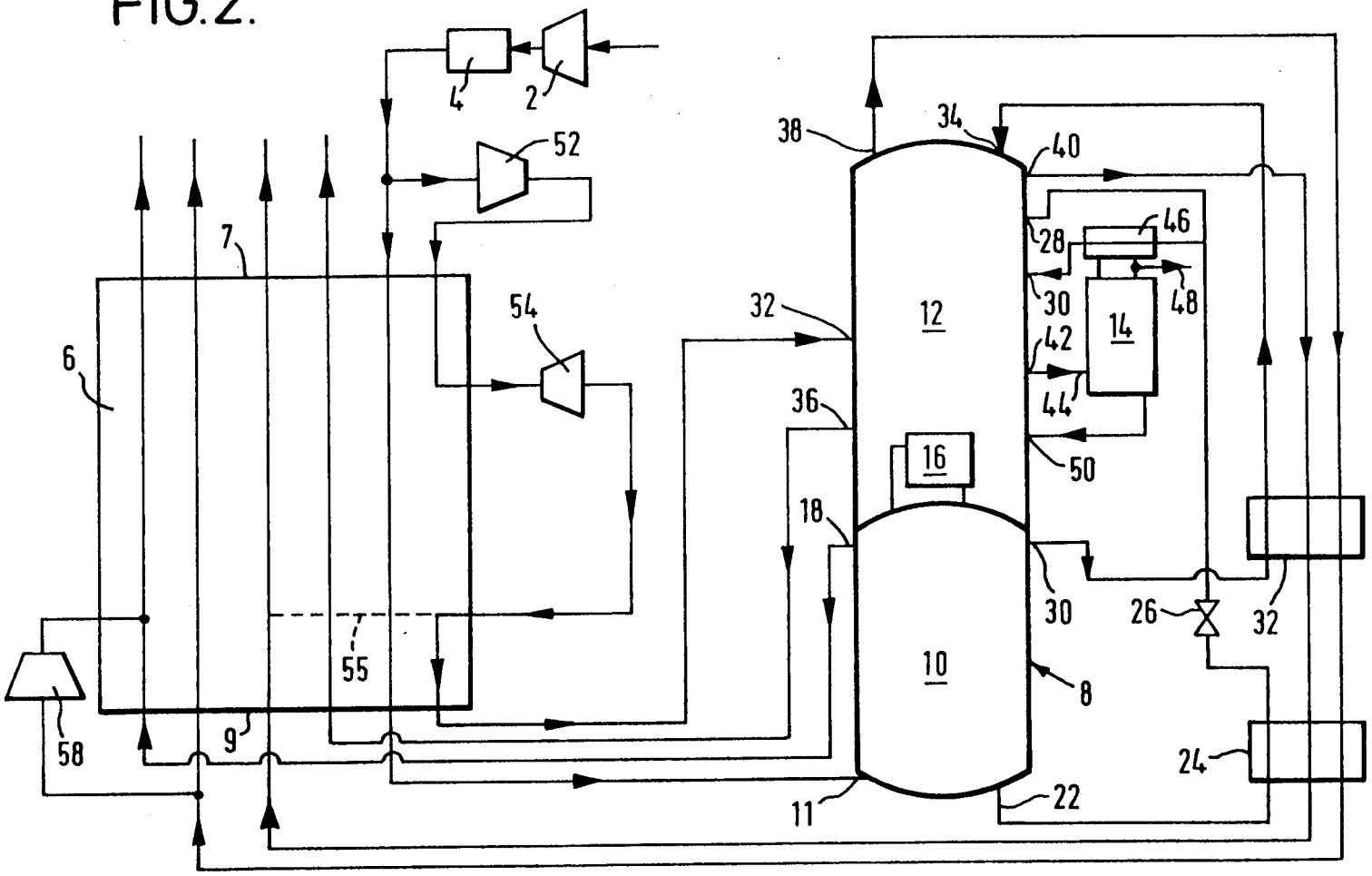
FIG. 2 is a schematic flow diagram illustrating a second method and apparatus according to the invention.

Referring now to FIG. 2, there is illustrated a variant of the method and apparatus shown in FIG. 1. In this variant, all the air flowing through the compressor 52 is withdrawn for expansion in the turbine 54 at a temperature in the range 200 to 250K. and returns to the heat exchanger 6 at a temperature in the range 120° to 150° K. Thus, the turbine 56 and its associated conduits are omitted from the apparatus shown in FIG. 2. Instead, a 'cold' nitrogen turbine 58 is provided. In this example, a part of the higher pressure nitrogen stream withdrawn from the outlet 18 of the higher pressure stage 10 of the rectification column 8 is taken at a temperature in the range of 120° to 150° K. from the heat exchanger 6, is expanded in the turbine 58 with the performance of external work, and is united with the nitrogen product stream (withdrawn from the lower pressure stage 12 of the rectification column 8 through the outlet 38) at the pressure and typically the temperature of that stream immediately upstream of its entry into the cold end 9 of the heat exchanger 6. The operation of the turbines 54 and 58 enable the temperature profile of the streams being warmed in the heat exchanger 6 to be kept in close conformity with that of the streams being cooled.

Figure 3:
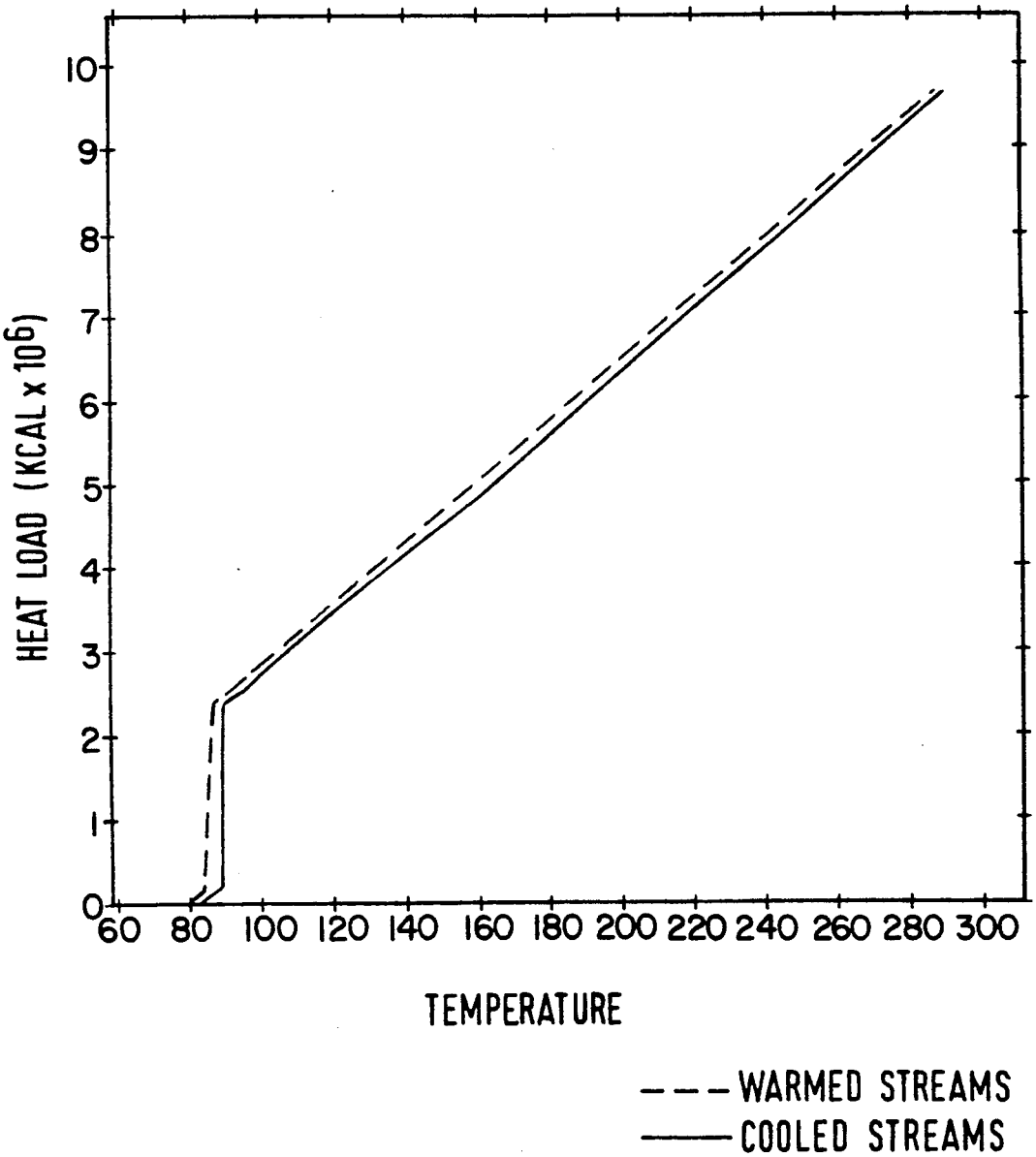
FIG. 3 is graph of heat load plotted against temperature for the heat exchanger of a conventional air separation plant using a low pressure drop liquid-vapour contact means in the lower pressure stage of the double column.

In FIG. 3, we show a plot of heat load against temperature for the streams being warmed and cooled in the corresponding heat exchanger of a conventional cycle for separating air when used in conjunction with a double rectification column and argon side column using a low pressure drop liquid-vapour contact means. This conventional plant uses only one turbine having an inlet pressure and temperature of 8.2 bar and 162° K. and having an outlet pressure and temperature of 1.3 bar and 102° K. whereby the resulting expanded air is partially introduced into the lower pressure stage of the double rectification column and the remainder exits into the waste nitrogen stream. It can be seen from FIG. 3 that the temperature profile of the streams being warmed matches that of the streams being cooled quite closely. It is therefore far from apparent that the operation of a plant as described and shown in FIG. 3 gives rise to significant inefficiencies in heat exchanger operation.

Figure 4:
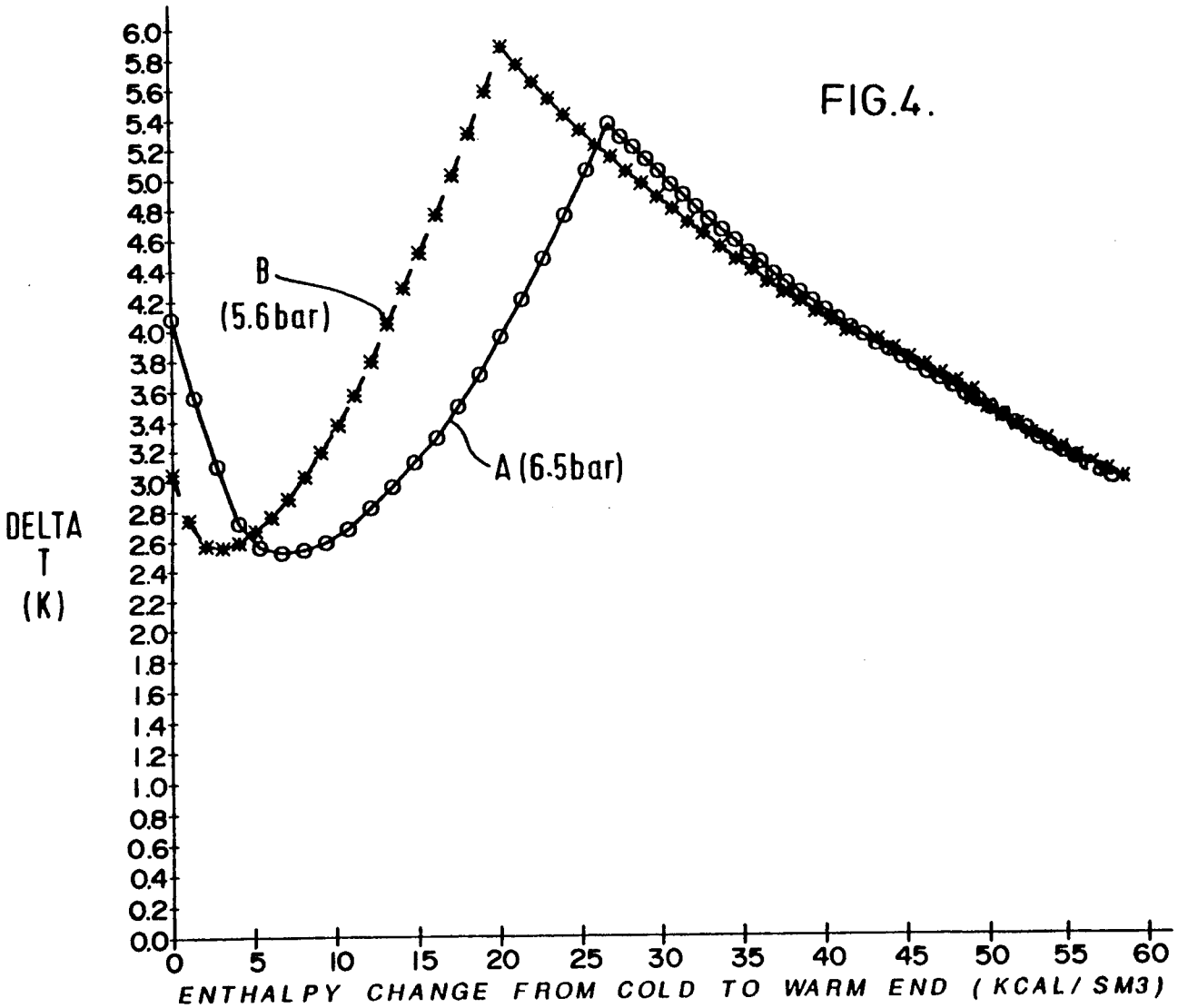
FIGS. 4 and 5 show plots of the temperature difference between the streams being warmed and the streams being cooled against the heat load for a conventionally operated air separation plant with conventional trays in its columns (FIG. 4 only), for a plant operating a conventional cycle but with a low pressure drop liquid-vapour contact means in the low pressure stage of the double column) (FIGS. 4 and 5), and a plant which is as shown in FIG. 1 of the accompanying drawings (FIG. 5 only).
Figure 5:
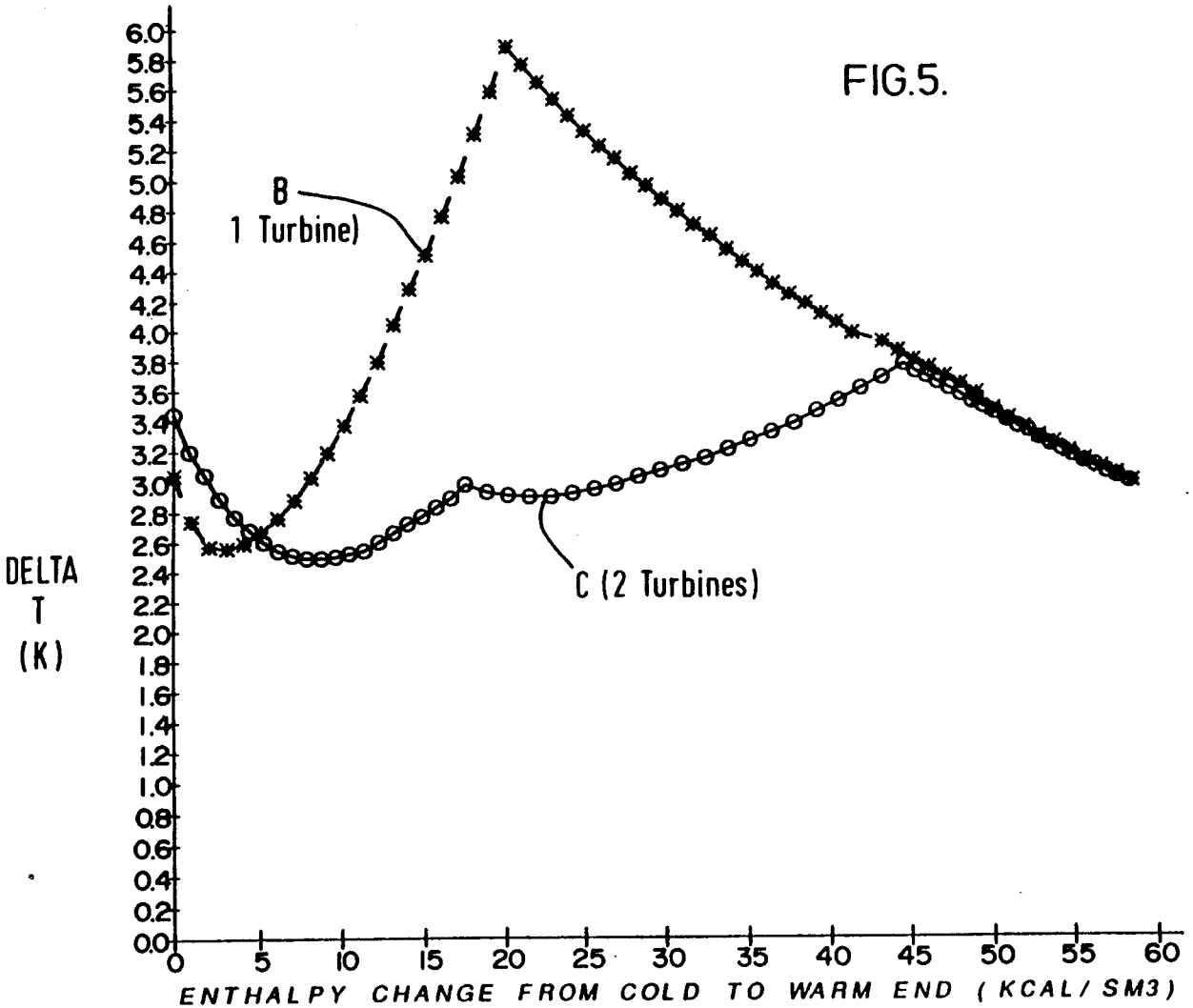

We chose to investigate the operation of the standard plant with a low pressure drop liquid-vapour contact means further and analysed the variation of the temperature difference between the streams being warmed and those being cooled with position in the main heat exchanger as indicated by the heat load. It will be seen from curve A in FIG. 4 that the maximum delta T rises to almost 5.5° K. Curve B shows the same temperature profile for a plant identical to the one analysed in FIG. 3 save that standard distillation trays not having a low pressure drop are used in the rectification columns. It can readily be seen that the temperature differences between the streams being warmed and the streams being cooled are appreciably higher in the latter case than in the former case. There is therefore considerable additional inefficiency entailed in the operation of the conventional plant with low pressure drop liquid-vapour contact means. Curve C (see FIG. 5) illustrates the operation of the heat exchanger 6 in an apparatus as shown in FIG. 1. The operating parameters of this plant are such that the turbine 54 has an inlet pressure and temperature of 8.8 bar and 244° K. respectively and an outlet pressure and temperature of 1.25 bar and 95° K. respectively. The outlet pressure of the compressor 2 is 5.6 bar. Accordingly the air enters the higher pressure stage 10 of the double rectification column 8 through the inlet 11 at a pressure of about 5.2 bar. It can be seen from an inspection of FIGS. 4 and 5 that the area enclosed by Curve C is considerably less than that enclosed either by Curve A or Curve B. Thus, the method (according to the invention) represented by Curve C is considerably more efficient than those represented by Curves A and B. Accordingly, the method and apparatus according to the invention make possible relatively efficient operation of the air separation plant when a low pressure drop liquid-vapour contact means is used in the rectification columns of the plant.

I claim:

1. A method of separating an oxygen product from air, including: reducing the temperature of a compressed air stream by heat exchange in heat exchange means to a value suitable for its separation by rectification; introducing the thus cooled air stream into the higher pressure stage of a double rectification column for the separation of air; said double rectification column comprising a lower pressure stage and a higher pressure stage; employing the higher pressure stage of the column to provide liquid nitrogen reflux and an oxygen-enriched air feed for the lower pressure stage; and withdrawing oxygen product from the lower pressure stage; wherein at least about 70.0% of the oxygen product is taken as gas from the double rectification column; at least the lower pressure stage includes a low pressure drop liquid-vapour contact means, having a pressure drop of less than about 400.0 Pa per theoretical stage of separation for effecting intimate contact and hence mass transfer between liquid and vapour; and wherein refrigeration for the method is created in two steps by performing at least two separate expansions of fluid with the performance of external work, a first such expansion taking fluid from the heat exchange means at a higher temperature and returning the fluid thereto at a lower temperature, both said higher and lower temperatures being between the temperature of the air stream at the cold end and that at the warm end of the heat exchange means; and a second such expansion producing fluid at a lowermost of no greater than temperature that at which the said compressed air stream leaves the cold end of the heat exchange means.

2. The method of claim 1, in which at least one of the at least two separate expansions is performed on compressed air taken from the compressed air stream.

3. The method of claim 1, in which the first expansion produces fluid at a temperature in a range of between about 120.0° K. and about 160.0° K.

4. The method of claim 1, in which the fluid for the second expansion is taken from the heat exchange means at a temperature in a range of between about 120.0° K. and about 160.0° K.

5. The method of claim 1, in which one of the expansions is performed on a nitrogen stream withdrawn from the higher pressure stage of the rectification column.

6. The method of claim 1, in which the oxygen product is taken as one of entirely as gas and less than about 10.0% by volume of the oxygen product is produced in liquid state.

7. The method of claim 1 in which the low pressure drop liquid-vapour contact means comprises structured packing.

8. The method of claim 1 in which the higher pressure stage of the double rectification column operates at a pressure, half way up the stage, in the range of between about 4.5 and about 5.5 bar.

9. An apparatus for separating an oxygen product from air comprising: a main air compressor; heat exchange means for reducing a compressed air stream from the main air compressor to a temperature suitable for its separation by rectification; a double rectification column having a lower pressure stage and a higher pressure stage, the higher pressure stage communicating with an outlet for the compressed air stream from the heat exchange means and at least the lower pressure stage including a low pressure drop liquid-vapour contact means having a pressure drop of less than 400 Pa per theoretical stage of separation for effecting intimate contact and hence mass transfer between liquid and vapour; two conduits leading from the lower pressure stage to the higher pressure stage for transferring respectively oxygen-rich fluid from the bottom of the lower pressure stage and liquid nitrogen from the top of the higher pressure stage to the lower pressure stage; an oxygen product conduit and a nitrogen conduit leading back from the low pressure column to the cold end of the heat exchange means whereby oxygen and nitrogen are able to pass back through the heat exchange means in countercurrent heat exchange relationship to the incoming air; the oxygen product conduit arranged so as to enable at least about 70.0% of the oxygen product to be taken as gas; a first expansion turbine for producing refrigeration for the apparatus which in use takes fluid from the heat exchange means at a higher temperature and returns the fluid thereto at a lower temperature, both said higher and lower temperatures being between the temperature of the air stream at the cold end and at the warm end of the heat exchange means; and a second such expansion turbine which in use has an outlet temperature at or below that at which the compressed air stream leaves the cold end of the heat exchange means.

10. The apparatus of claim 9, in which the low pressure liquid-vapour contact means comprises structured packing.

* * * * *